US005365747A

United States Patent [19]

Werbowsky et al.

[11] Patent Number: 5,365,747

[45] Date of Patent: Nov. 22, 1994

[54] COMPRESSOR PROTECTION DISPLAY

[76] Inventors: Laurie L. Werbowsky, 6400 Hedgeroe La., Jamesville, N.Y. 13078; Glenn D. Goodnough, 1506 Grant Blvd., Syracuse, N.Y. 13208

[21] Appl. No.: 172,318

[22] Filed: Dec. 23, 1993

[51] Int. Cl.[5] ..... F25B 49/02

[52] U.S. Cl. ..... 62/126; 62/158

[58] Field of Search ..... 62/126, 125, 127, 129, 62/130, 229, 157, 158, 231; 165/11 R; 236/94; 361/22

[56] References Cited

U.S. PATENT DOCUMENTS 4,034,570 7/1977 Anderson et al. ..... 62/158
4,307,775 12/1981 Saunders et al. ..... 62/127 X
4,381,549 4/1983 Stamp, Jr. et al. ..... 62/126

*Primary Examiner*—Harry B. Tanner

[57] ABSTRACT

A process for activating an air conditioning unit includes checking the unit's compressor for possibly being in a recovery status condition. A message is displayed on a control panel as long as the unit's compressor remains in this condition. The display includes an indication as to the time remaining before the compressor will be activated.

14 Claims, 5 Drawing Sheets

COMPRESSOR PROTECTION DISPLAY

BACKGROUND OF THE INVENTION

This invention relates to the response of an air conditioning unit to an attempted activation of the unit during a compressor recovery period.

Control panels for today's air conditioning units provide a person with a considerable number of selectable options. These control panels do not however always provide pertinent information as to the unit's status and ability to respond to the person's selections. For instance, a person may use the control panel to select a desired temperature for the room the unit is in. The person will then wait for a timely generation of heated or cooled air by the unit. This may not occur as soon as the person would like if the unit's compressor is in a recovery period. This may lead to a conclusion that the unit is not operating properly and a request for servicing or replacement of the unit even though the unit is functioning properly.

OBJECTS OF THE INVENTION

It is an object of the invention to provide an air conditioning unit with an ability to respond to a person's selective activation of the unit when the unit's compressor is in a recovery period.

BRIEF DESCRIPTION OF THE DRAWINGS

The above and other objects and advantages of the present invention will be apparent from the foregoing description in conjunction with the accompanying drawings in which.

SUMMARY OF THE INVENTION

The above and other objects of the invention are achieved by an air conditioning unit which responds to a person's temperature selection by first checking the status of the unit's compressor. If the unit's compressor is off, an inquiry will be made as to how long the compressor must remain off. A message will be generated for display on the unit's control panel that alerts the user of the compressor's off condition. This message will be followed by the display of the amount of time remaining before the unit will further respond to the person's temperature selection. These messages will continue to be displayed alerting the user as to the amount of time remaining until the compressor can be switched on. The messages are deleted at this point.

DESCRIPTION OF THE PREFERRED EMBODIMENT

Figure 1:
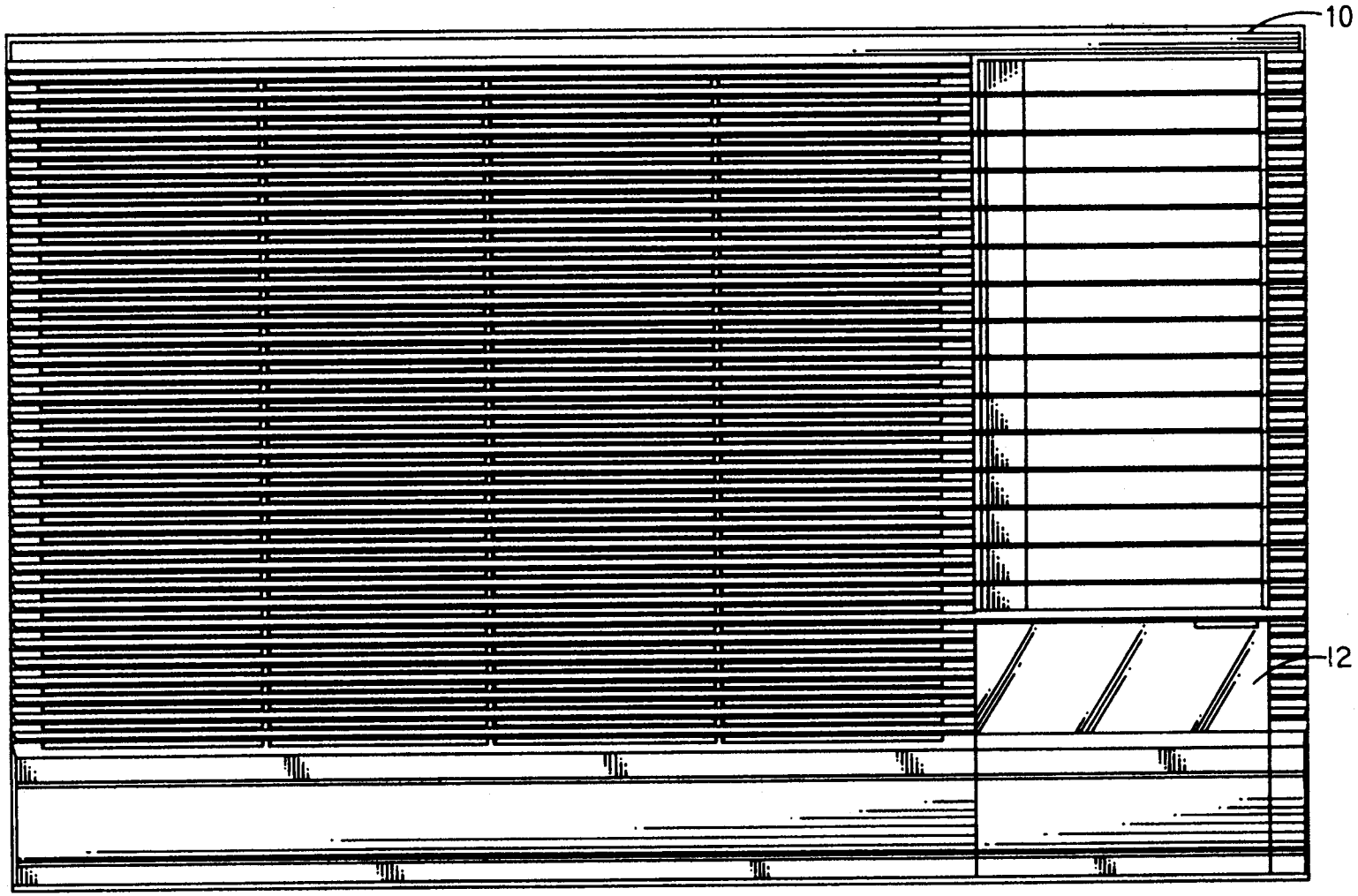
FIG. 1 illustrates an air conditioning unit having a transparent door covering a control panel.
Figure 2:
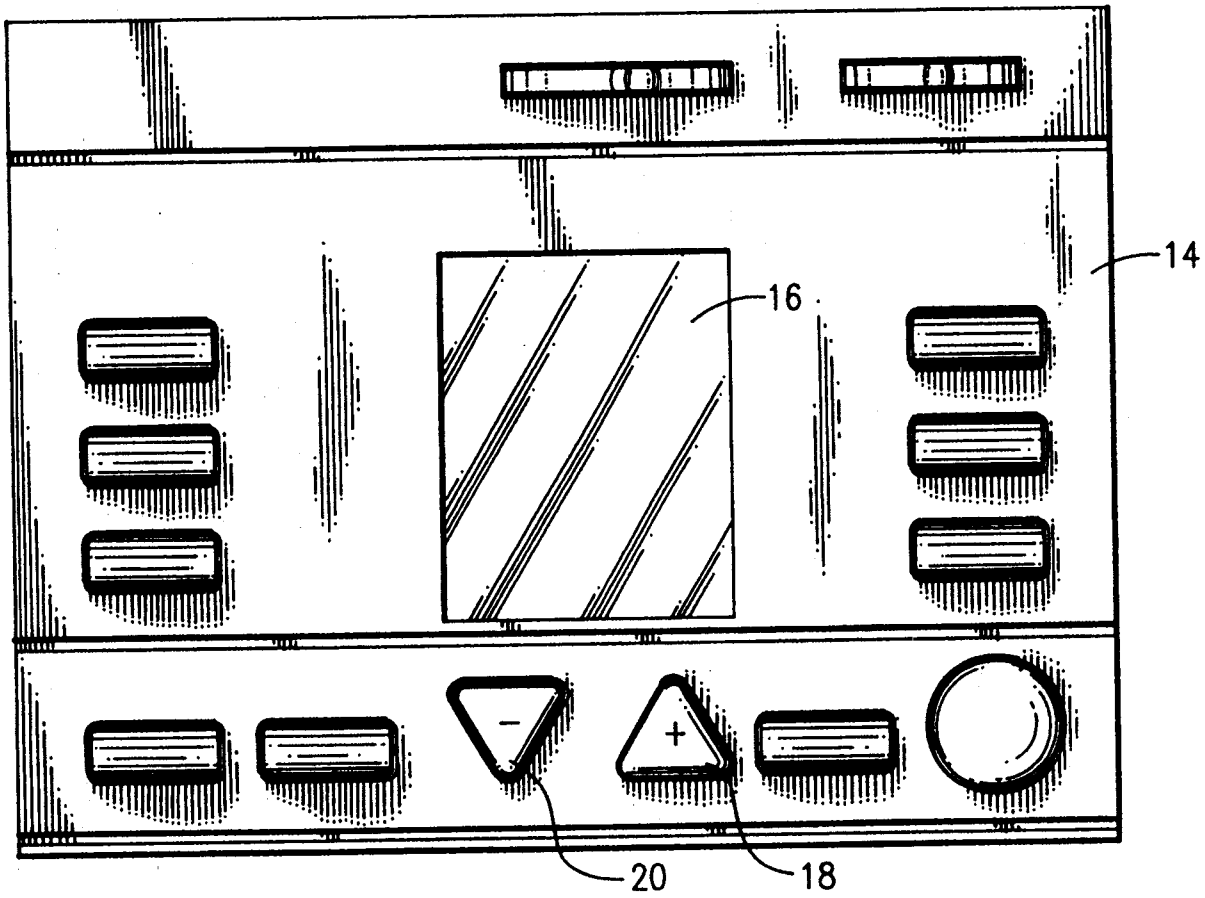
FIG. 2 illustrates the control panel behind the transparent window of the air conditioning unit of FIG. 1.

Referring to FIG. 1, a window room air conditioning unit 10 is seen to include a transparent door 12 preferably hinged in such a fashion as to allow a person to easily open the door to access a control panel. Referring to FIG. 2, the control panel 14 located behind the transparent door 12 is seen to include a liquid crystal display (LCD) 16 as well as a plurality of touch sensitive switches. These switches include a touch sensitive switch 18 that will increment a temperature displayed on the LCD 16 and a touch sensitive switch 20 that will decrement a displayed temperature.

Figure 3:
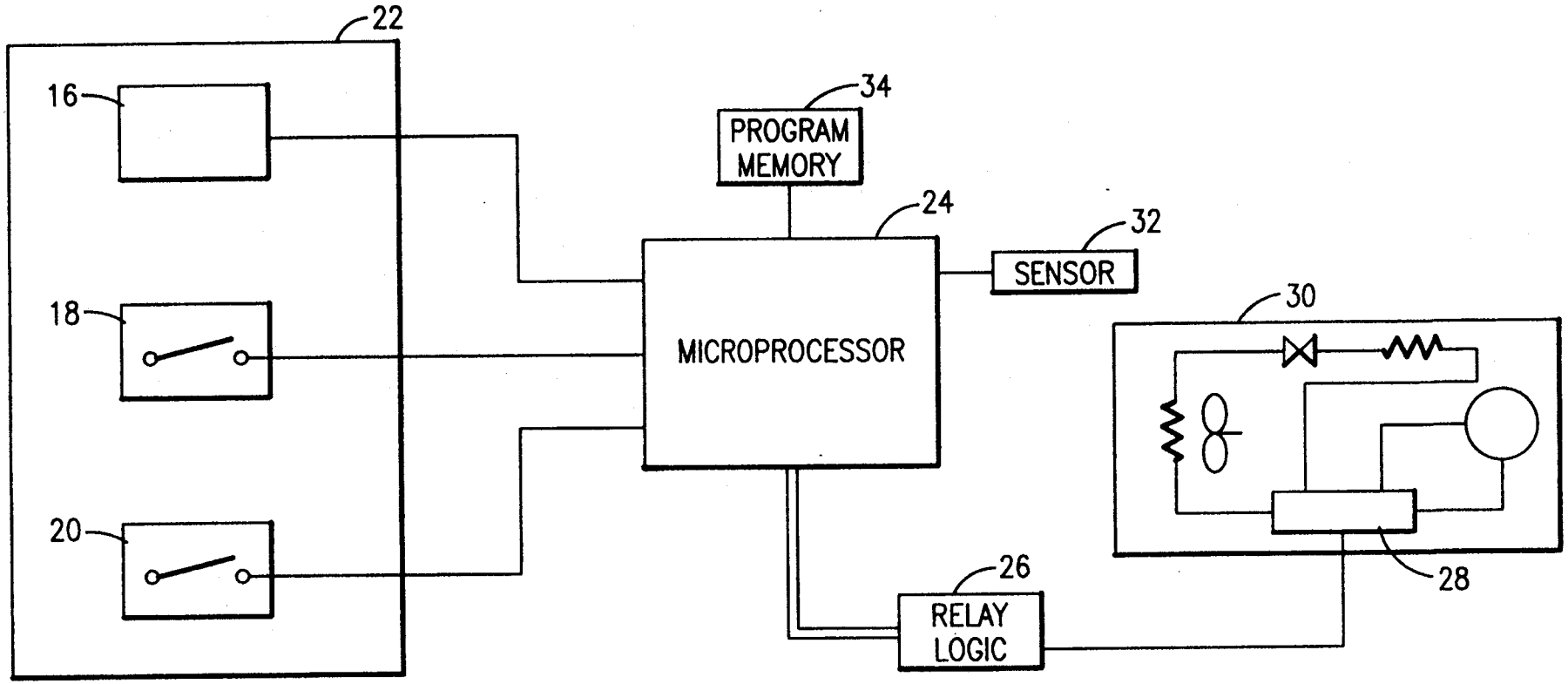
FIG. 3 illustrates a microprocessor based control system interfacing with the control panel of FIG. 2.

Referring to FIG. 3 a portion 22 of the control panel containing the LCD 16 and the touch sensitive switches 18 and 20 is further illustrated relative to a microprocessor 24. In particular, the LCD 16 and the touch sensitive switches 18 and 20 are seen to be operatively connected to the microprocessor 24. The microprocessor 24 is also operatively connected to relay logic 26 which in turn provides an appropriate control level signal to a compressor 28 forming part of a conventional heating or cooling system 30 within the air conditioning unit. The microprocessor 24 is furthermore connected to a sensor 32 which senses the temperature of the space that is to be heated or cooled by the air conditioning unit 10. It is to be understood that the microprocessor will normally send signals to the relay logic 26 for control of the various elements forming the heating or cooling system 30. The signals to the relay logic are often in response to various switches being activated on the control panel. The microprocessor will furthermore cause messages to be displayed on the LCD 16 in a manner which will be explained in detail hereinafter. The microprocessor performs these various tasks by executing instructions stored in a program memory 34.

Figure 4A:
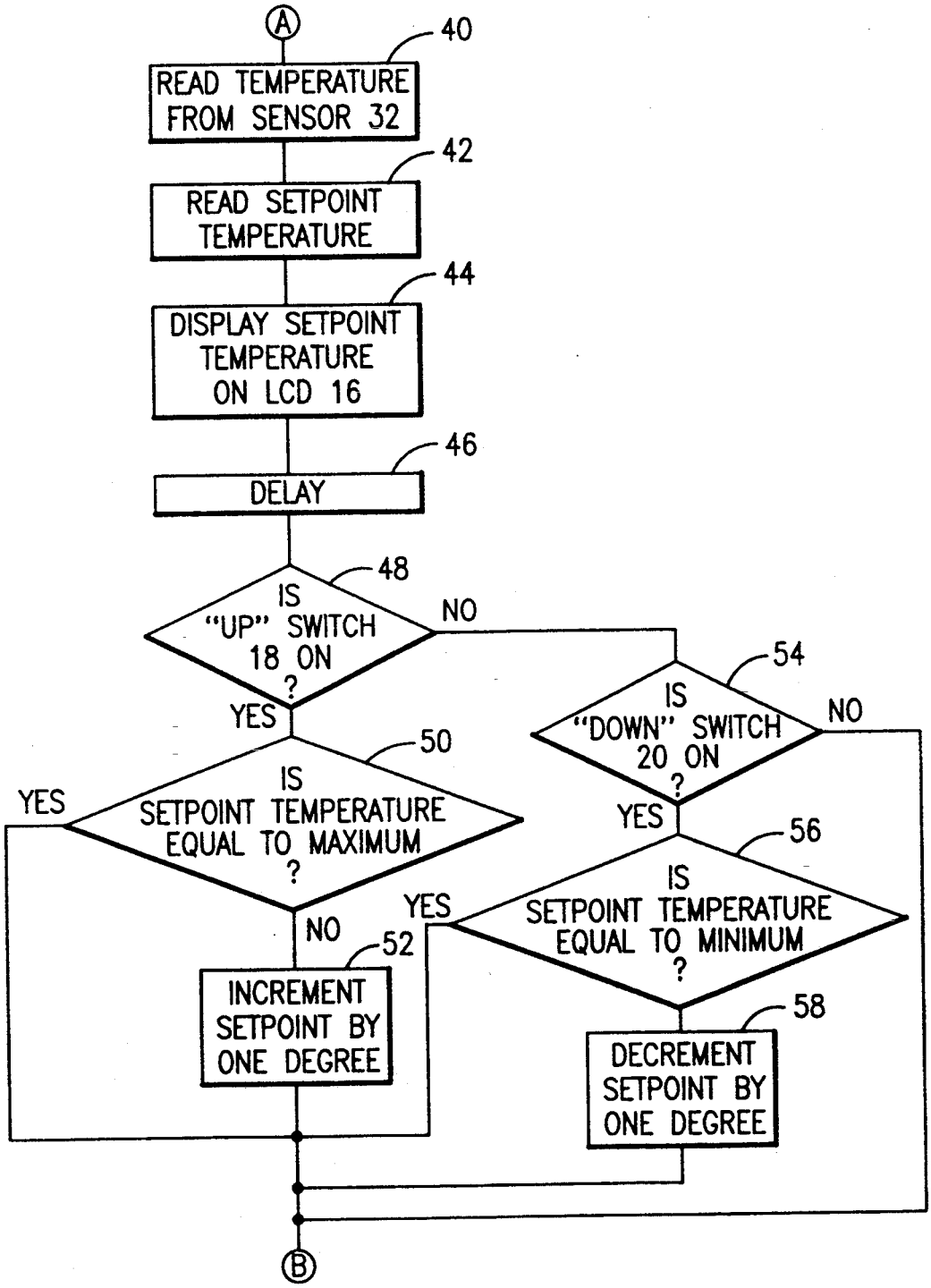
FIGS. 4A and 4B illustrate a stored process executable by the microprocessor based control system of FIG. 3.

Referring to FIG. 4A, a flow chart of the executable steps performed by the microprocessor 24 is illustrated. The first step 40 is a reading of the temperature from the sensor 32. This is followed by a reading in step 42 of the setpoint temperature value currently stored in the program memory 34. This setpoint temperature value is displayed on the LCD 16 in a step 44. The microprocessor now initiates a delay in a step 46. This delay should be of sufficient time for a person to view and react to the thus displayed setpoint temperature. Following the delay of step 46, the microprocessor proceeds to inquire as to whether the up switch 18 is on. If the up switch has been depressed, the microprocessor will proceed to a step 50 and inquire as to whether the setpoint temperature presently stored in the program memory 34 is equal to a maximum allowable setpoint temperature that has also been stored in the program memory. In the event that the setpoint temperature has not reached maximum, the microprocessor will proceed to a step 52 and increment the stored setpoint temperature by one degree in a step 52. It is to be appreciated that this incremented setpoint temperature will become the new setpoint temperature stored in program memory 34. Referring to step 50, it is to be noted that if the setpoint temperature is at a maximum, the step 52 will merely be bypassed.

Referring to step 48, in the event that the up switch is not depressed, the microprocessor will proceed to a step 54 and inquire as to whether the down switch 20 has been depressed. In the event that the down switch has been depressed, the microprocessor will proceed to a step 56 and inquire as to whether the currently stored setpoint temperature is equal to any minimum allowed setpoint temperature. If setpoint temperature is above the allowable minimum, the microprocessor will proceed to a step 58 and decrement the setpoint temperature by one degree. Referring again to step 56, in the event that the setpoint temperature is at the minimum allowable, the microprocessor will proceed to the same point downstream of the steps 50, 52, and 58. This point is denoted as Junction B in FIG. 4A.

Figure 4B:
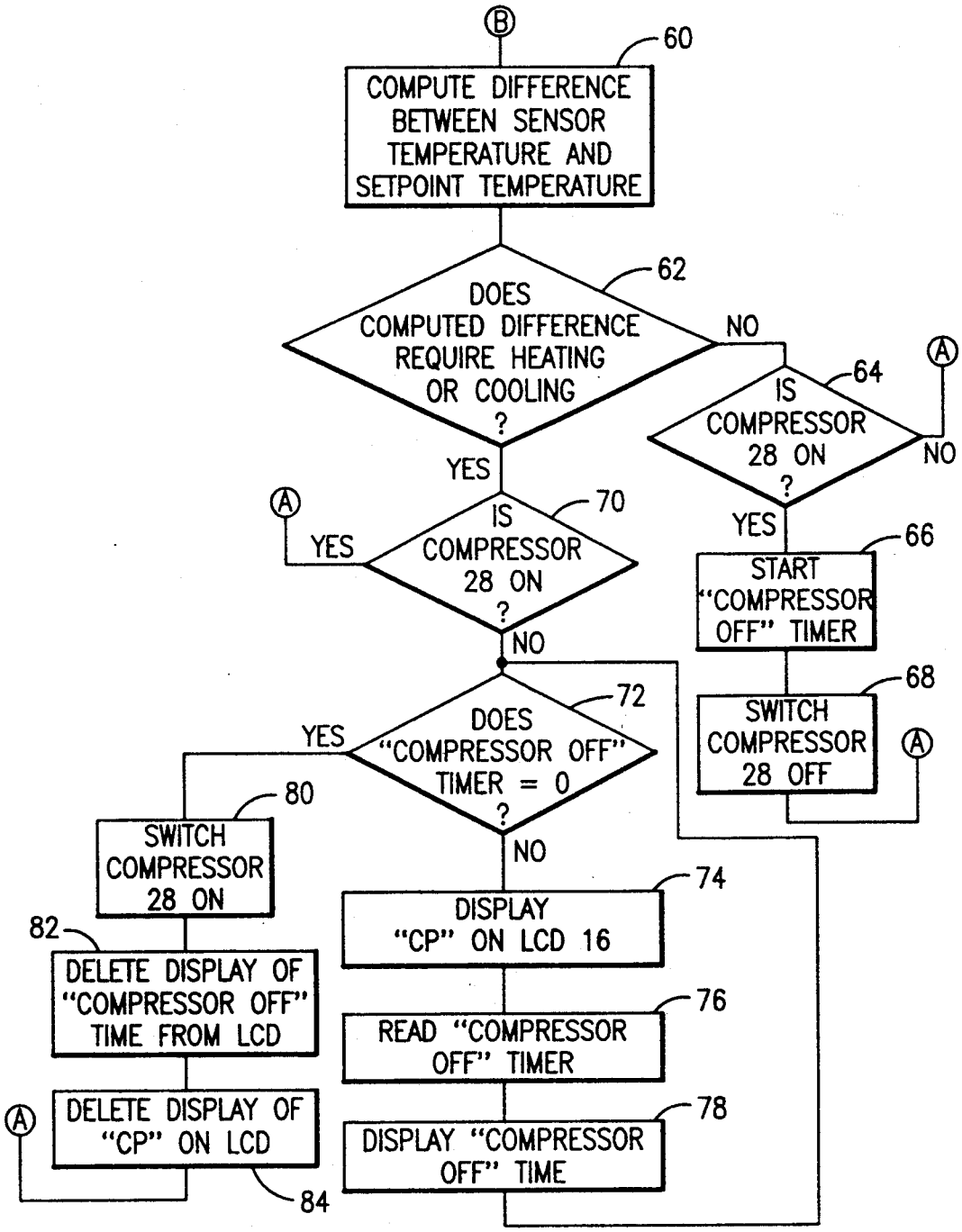

Referring to FIG. 4B, the microprocessor proceeds from either step 50, 52, 56, or 58 to a step 60 and computes the difference between the temperature of the sensor 32 and the thus defined setpoint temperature. The microprocessor next proceeds to inquire in a step 62 as to whether the computed difference in step 60 requires heating or cooling. In this regard, there is preferably a differential range of temperature from setpoint which will be permitted without triggering any heating or cooling. This permissible variation in temperature is compared with the computed difference of step 60. If the computed difference is less than the permissible deviation from setpoint, the microprocessor will proceed to a step 64 and inquire as to whether the compressor 28 is on. This inquiry is preferably made by checking the command issued by the microprocessor to the relay logic 26. This command will either indicate that the compressor has been commanded to an "on" or an "off" state. If the command by the microprocessor 24 is an "On" command, then the microprocessor will proceed to a step 66 and start a "Compressor Off" timer. The microprocessor will next proceed to a step 68 and issue a "Compressor Off" signal to the relay logic 26. The relay logic will immediately switch the compressor 28 to an "off" state. The microprocessor will next proceed back to step 40 and again read the temperature from the sensor 32. Referring to step 64, if the compressor 28 is already in an "off" state, then the microprocessor will proceed out of step 64 back to step 40.

Referring again to step 62, in the event that the computed difference from step 60 is not within the permissible range from setpoint, the microprocessor will proceed to a step 70 and inquire as to whether the compressor 28 is "on". As has been previously noted in step 64, this is a check as to whether a "Compressor On" command for the compressor 28 has issued from the microprocessor 24 to the relay logic 26. In the event that a "Compressor On" command is in effect, the microprocessor will proceed back to step 40 and read the temperature from the sensor 32. If however the command state is for a "Compressor Off" condition, the microprocessor will proceed to a step 72 and inquire as to whether the "Compressor Off" timer is equal to zero. It will be remembered that the "Compressor Off" timer is initiated in step 66. The "Compressor Off" timer is preferably a timer that begins decrementing from a predefined period of time during which the compressor is to be maintained in an "off" state before it can be again activated. This time should be sufficient to allow the compressor 28 to recover from any previous "on" state. Referring again to step 72, if the "Compressor Off" timer has not expired, the microprocessor will proceed to a step 74 and issue a display message to the LCD 16. The display may for instance state: "CP" which is to be interpreted as "COMPRESSOR PROTECT". While this message is being displayed on the LCD 16, the microprocessor will proceed in a step 76 to read the current value of the "Compressor Off" timer. The microprocessor will next proceed to issue a command to the LCD 16 to display the thus read "Compressor Off" time in a step 78. The microprocessor will return to step 72 and again inquire as to whether the "Compressor Off" timer is equal to zero. As long as time remains, the microprocessor will proceed to refresh the LCD 16 with the "CP" message and update the current time remaining. In this manner, the LCD 16 will continue to display the "CP" message along with an ever decreasing display of time indicative of the "Compressor Off" timer being continuously decremented.

When the "Compressor Off" timer has expired, the microprocessor will exit from step 72 to a step 80 and issue a "Compressor On" signal to the relay logic 26 switching the compressor 28 to an "on" state. The microprocessor will next proceed in steps 82 and 84 to delete the currently displayed "CP" and "Compressor Off" timer on the LCD 16. Following deletion of the various displayed messages on the LCD 16, the microprocessor will proceed back to step 40 and again begin the process of reading and computing temperatures as has been previously discussed.

It is to be appreciated that the microprocessor 24 will continue to execute the process of FIGS. 4A and 4B so as to display appropriate messages on the LCD 16 when a person is attempting to activate the air conditioning unit for heating or cooling when the compressor 28 is in a recovery state. Such displaying of messages will alert the person that there is nothing wrong with the air conditioning unit other than the need to await the expiration of the compressor recovery period.

It is to be appreciated that a particular embodiment of the invention has been described. Alterations, modifications and improvements thereto will readily occur to those skilled in the art. Accordingly, the foregoing description is by way of example only and the invention is to be limited only by the following claims and equivalents thereto.

What is claimed is:

1. In an air conditioning unit having a control panel for selecting a setpoint temperature and a heating or cooling system for providing conditioned air in response to a difference between selected setpoint temperature and a sensed temperature, a process for activating the heating or cooling system comprising the steps of:

defining an availability status of a compressor within the heating or cooling system, the availability status indicating whether the compressor can be immediately activated;

monitoring the difference between selected setpoint temperature and the sensed temperature;

checking the availability status of the compressor when the difference between the selected setpoint temperature and the sensed temperature reaches a predetermined amount; and displaying a message on the control panel indicating the compressor cannot be immediately activated when the difference between selected setpoint temperature and the sensed temperature reaches a predetermined amount and the availability status of the compressor within the heating or cooling system indicates that the compressor cannot be immediately activated.

2. The process of claim 1 wherein said step of defining the availability status of the compressor includes the step of defining the amount of time remaining before the compressor can be activated and wherein said step of displaying a message indicating the compressor cannot be immediately activated comprises the step of:

displaying the amount of time remaining before the compressor can be activated.

3. The process of claim 2 wherein said step of checking the availability status of the compressor when the difference between the selected setpoint temperature and the sensed temperature reaches a predetermined amount comprises the step of checking whether the amount of time remaining before the compressor can be activated has expired and wherein said steps of checking the amount of time remaining and displaying the amount of time remaining before the compressor can be activated are repeated until the amount of time remaining before the compressor can be activated has expired.

4. The process of claim 3 further comprising the steps of:

deleting the display of the amount of time remaining when said step of checking the amount of time remaining before the compressor can be activated indicates that the amount of time remaining has expired; and commanding the compressor to switch to an on state.

5. The process of claim 2 wherein said step of displaying a message indicating the compressor cannot be activated further comprises the step of:

displaying a compressor status message in conjunction with the display of the amount of time remaining before the compressor can be activated.

6. The process of claim 1 further comprising the step of:

checking whether the compressor is currently running prior to checking the availability status of the compressor; and proceeding to said step of checking the availability status of the compressor only when the compressor is not currently running.

7. The process of claim 1 wherein said step of monitoring any difference between selected setpoint temperature and the sensed temperature comprises the steps of:

reading a currently selected setpoint temperature for the air conditioning unit from the control panel;

sensing the temperature of the space which is to be heated or cooled by the conditioned air; and calculating the difference between the currently selected setpoint temperature and the sensed temperature of the space which is to be heated or cooled.

8. The process of claim 7 wherein said step of reading a currently selected setpoint temperature for the air conditioning unit comprises:

checking whether a setpoint temperature upward adjustment switch has been depressed on the control panel of the unit; and incrementing the currently stored setpoint temperature by one degree when the currently stored setpoint temperature is less than the maximum allowable setpoint temperature.

9. The process of claim 8 wherein said step of reading a currently selected setpoint temperature for the air conditioning unit comprises:

checking whether a setpoint temperature downward adjustment switch has been depressed on the control panel of the unit;

decrementing the currently stored setpoint temperature by one degree when the currently stored setpoint temperature is greater than the minimum allowable setpoint temperature.

10. In an air conditioning unit which may be activated to provide conditioned air, a process for responding to an attempt to immediately activate the unit, said process comprising the steps of:

defining an on command that normally activates a compressor within the air conditioning unit when conditioned air is to be provided by the unit;

changing the on command to an off command so as to deactivate the compressor when the unit is no longer required to provide conditioned air; and defining the amount of time that the compressor must remain off in response to said step of changing the command; and continuously decrementing the amount of time that the compressor must remain off until the time expires; and displaying a message on a display associated with the unit when the amount of time remaining has not expired in response to an attempt to activate the air conditioning unit.

11. The process of claim 10 wherein said step of displaying a message on a display associated with the unit comprises the step of:

displaying the amount of time that the compressor must remain off until the time expires.

12. The process of claim 11 wherein said step of displaying a message on a display associated with the unit further comprises the step of:

displaying a compressor status message in conjunction with the display of the amount of time that the compressor must remain off.

13. The process of claim 11 further comprising the steps of:

changing the off con, hand to an on command when the amount of time that the compressor must remain off has expired; and deleting the display of the amount of time that the compressor must remain off.

14. The process of claim 10 further comprising the step of:

changing the off command to an on command when the amount of time that the compressor must remain off has expired; and deleting the display of a message on a display associated with the unit when the amount of time that the compressor must remain off has expired.

* * * * *